US006154699A

United States Patent [19]

Williams

[11] Patent Number: 6,154,699

[45] Date of Patent: Nov. 28, 2000

[54] GRITTING SYSTEMS AND METHODS

[76] Inventor: Brian Williams, The Croft, The Lane, Wernffrwd, North Gower, SA4 3TU Wales, United Kingdom

[21] Appl. No.: 09/051,101

[22] PCT Filed: Oct. 7, 1996

[86] PCT No.: PCT/GB96/02454

§ 371 Date: Aug. 31, 1998

§ 102(e) Date: Aug. 31, 1998

[87] PCT Pub. No.: WO97/13926

PCT Pub. Date: Apr. 17, 1997

[30] Foreign Application Priority Data

Oct. 6, 1995 [GB] United Kingdom ..... 9520478

[51] Int. Cl.[7] ..... E01H 10/00

[52] U.S. Cl. ..... 701/50; 701/213; 239/1; 239/69

[58] Field of Search ..... 701/50, 207, 209, 701/213, 215, 2; 342/357.01, 357.17; 340/988, 990, 995, 905; 239/1, 69, 73, 74, 100, 101, 171, 172

[56] References Cited

U.S. PATENT DOCUMENTS

| | | | |
|---|---|---|---|
| 4,630,773 | 12/1986 | Ortlip | 239/1 |
| 4,812,991 | 3/1989 | Hatch | 342/357 |
| 4,986,384 | 1/1991 | Okamoto et al. | 701/2 |
| 5,220,876 | 6/1993 | Monson et al. | 239/1 |
| 5,318,226 | 6/1994 | Kime et al. | 239/1 |
| 5,619,193 | 4/1997 | Doherty et al. | 340/905 |
| 5,646,846 | 7/1997 | Bruce et al. | 701/50 |
| 5,653,389 | 8/1997 | Henderson et al. | 239/69 |
| 5,745,051 | 4/1998 | Doherty et al. | 340/905 |
| 5,754,137 | 5/1998 | Durrstein | 701/50 |
| 5,904,296 | 5/1999 | Doherty et al. | 701/50 |
| 5,919,242 | 7/1999 | Greatline et al. | 701/50 |
| 5,938,709 | 8/1999 | Hale et al. | 701/50 |

FOREIGN PATENT DOCUMENTS 39 38 147 A1 6/1991 Germany .

*Primary Examiner*—Gary Chin

*Attorney, Agent, or Firm*—Akin, Gump, Strauss, Hauer & Feld, L.L.P.

[57] ABSTRACT

Methods and systems for controlled gritting of routes. e.g. roads, are disclosed. A gritting vehicle (3) has a continuously-operating position detection arrangement e.g. GPS and has an on-board information processor (MDT) in which route data such as forecast thermal map data are stored. The stored data can be transmitted to the vehicle (3) from a control station processor via a radio link. Real-time positional data are compared with the route data in the vehicle's processor and generate gritting instructions to control whether and how much grit is deposited at a given location. Positional and gritting status information may be transmitted back to the control station (1) progressively for recording. On-board sensors (S) may be used to supplement forecast data.

23 Claims, 4 Drawing Sheets

| | x | y | z | m | n |
|---|---|---|---|---|---|
| 1 | ~ | ~ | ~ | ~ | ~ |
| 2 | ~ | ~ | ~ | ~ | ~ |
| 3 | ~ | ~ | ~ | ~ | ~ |
| 4 | ~ | ~ | ~ | ~ | ~ |
| 5 | ~ | ~ | ~ | ~ | ~ |
| 6 | ~ | ~ | ~ | ~ | ~ |
| 7 | ~ | ~ | ~ | ~ | ~ |

GRITTING SYSTEMS AND METHODS

FIELD OF THE INVENTION

The present invention relates to methods, apparatus and control systems for dispensing salt, grit or other substances on surfaces, for example for spreading salt or grit over icy roads

BACKGROUND

Measures are conventionally taken in a wide range of weather conditions for ensuring that highways, major urban roads and even more minor routes are kept open for traffic. In cold countries, or during wintery periods in more temperate climates, salt, grit or other substances are dispensed onto road surfaces to ameliorate driving conditions, for example by preventing or reducing build up of ice. Hereinafter the salt, grit or other substances, whether or not particulate, will be referred to simply as "grit", while the process by which they are applied will be termed "gritting".

Gritting is conventionally performed by gritting vehicles which carry a store of grit and travel along a predetermined route distributing grit across the road surface as they travel. Grit is dispensed at a substantially constant rate, although in special circumstances the driver may increase the rate.

Producing and supplying large quantities of grit is expensive. Furthermore, besides the beneficial effects of gritting there are also important detrimental effects Some grits cause significant environmental damage, or are corrosive to vehicles. For these reasons it is desirable that the amount of grit dispensed is minimised, while ensuring that roads are effectively treated.

Development in the technology is slow, since gritting is a vital safety service and no modification can be tolerated if it may reduce effectiveness. Nevertheless, techniques have recently been devised to help determine more accurately when it is necessary to carry out gritting. One such technology makes a "thermal map" of a geographical area by surveying the area to determine a map of the local temperature variations, due e.g. to exposure to cold winds. In particular a relevant kind of thermal map indicates which parts of major roads are prone to low temperatures. This fixed information can be combined with periodically or continuously updated information from local weather stations concerning actual weather in specific locations, to produce a "forecast thermal map" which approximates a predicted actual temperature distribution in a region. Graphical information can then be generated showing estimated temperature variation along each of the predetermined potential gritting routes, and hence showing which of such routes include stretches of road which are liable to become icy. If the entire length of a route should be free from ice, no gritting vehicle need pass along it. If it is found that a given route includes a potentially icy stretch of road then a vehicle is sent.

DE-A-3938147 describes a gritting system which seeks to reduce the mentioned difficulties by pre-determining a gritting rate profile based on knowledge of the route's temperature variation characteristics and the prevailing weather conditions; the profile is loaded into an on-board computer and used to operate a control mechanism for the gritting apparatus, controlling spreading density, width and lateral distribution profile. Change from one mode of spreading to another is actuated by occasional reflector plates positioned adjacent the route, which reflect radiation beams back to the vehicle.

In its broadest terms, the present invention proposes a gritting system in which the position of at least one gritting vehicle (preferably plural gritting vehicles) is monitored, preferably at an external control or tracking station and preferably substantially continuously or regularly.

In a first aspect we provide a method of gritting in which the location of at least one gritting vehicle is monitored and the dispersement of grit is controlled in dependence on a predetermined gritting requirement at that location. In this way, the efficiency of the gritting may be enhanced.

The control is preferably exercised in dependence upon a predicted temperature at the location of the gritting vehicle, e.g. the predicted temperature of that location according to a forecast thermal map.

As a first example, grit may be dispensed only along portions of the route including stretches which the forecast thermal map has estimated to be at or below zero degrees Celsius. The gritted portions may in fact substantially correspond to the sub-zero stretches of the route, but, more preferably, they include also adjacent stretches of the road so as to produce a safety margin.

As a second example, the control may not merely determine whether or not grit is dispensed along a given stretch of road but, more preferably, additionally (or indeed alternatively) the rate at which grit is dispensed. Thus, grit may be applied at a greater rate to those regions which are predicted to be at a lower temperature. Such control of the rate at which grit is dispensed optionally depends also upon the velocity of the gritting vehicle, for example so that the density of grit application (ie. rate of release of grit/velocity of the gritting vehicle) obeys a predetermined relationship with the predicted temperature.

The control of grit dispersion may in either case be automated, i.e. control means may be provided which controls the rate of gritting automatically in dependence on the predetermined local gritting requirement. Or, control may be via a human operator. For example the mechanism may calculate automatically whether or not, or to what extent, gritting should occur, and transmit a corresponding instruction to the driver of the gritting vehicle (eg. by indication lights or voice synthesis). The driver then controls the rate of gritting accordingly. Preferably, even in the most automated embodiments, the operator is able to at least influence the gritting, albeit as a manual override of an automatic mechanism, to exploit his or her personal knowledge, for example a knowledge of small local frost hollows or the presence of water on the road due to a burst pipe.

Preferably, a gritting vehicle carries one or more sensors for measuring at least one local weather or surface condition, for example surface temperature or residual salinity. Control of gritting may then be carried out also in dependence on the results of the measurement. For example, it is possible to monitor in real time any discrepancy between the predicted temperature in the vicinity of the gritting vehicle and the actual temperature. This permits updating and/or correction of the forecast thermal map. Thus, feedback is possible in which the gritting is controlled in real time in dependence upon measurements derived by the gritting vehicle. Another possibility is that the gritting rate is controlled in substantial or full dependence on such real-time measurements from one or more on-board sensors. In such cases a forecast thermal map may be used only for e.g. route selection (see below) and/or as a back-up indicator of the amount of grit required.

The control of gritting need not only be a control of the rate of gritting, but may additionally or alternatively include a control of the route taken by a gritting vehicle. Accordingly, in a second aspect the invention provides a method of gritting in which the location of at least one gritting vehicle is monitored and the route of the at least one gritting vehicle is controlled in dependence on the measured location of the vehicle.

As a first example, the route of a gritting vehicle need not be predetermined but may be selected on the basis of a forecast thermal map, for example so as to cover efficiently all especially cold roads. In this case, the monitored position of the gritting vehicle can be used to generate directional instructions to the driver.

A second example is when, as described above, a comparison of the information derived from one or more weather sensors mounted on the vehicle with the data from the corresponding location on the forecast thermal map indicates that weather has deteriorated. In this case, an update of the forecast thermal map may demonstrate that additional grit should be applied to a given stretch of road. Accordingly the gritting system may assign a gritting vehicle to perform the additional gritting of the road. The assignment preferably takes into account the location of the gritting vehicles, and/or the amount of grit each is carrying.

In a third aspect, the invention may provide a method of gritting in which the location of at least one gritting vehicle is monitored and the location information is collected in real time off the gritting vehicle or vehicles, for example after transmission to a central database. Thus, reliable and secure archiving may be performed, for example to establish whether or not gritting was performed correctly.

A desirable feature of a gritting system would be an accurate recordal or "archiving" of the manner in which gritting is carried out. This record can be valuable in the event of an accident, in determining whether gritting was adequate and apportioning liability. Accurate and secure records are becoming increasingly important because of the legal duty of ensuring that gritting is done correctly. At present no system of archiving is more sophisticated than a simple measurement and recordal of the weight of a gritting vehicle at the beginning and the end of a gritting session, from which only the average rate of gritting can be recorded.

In each aspect the monitoring of location is preferably by a Global Positioning System (GPS), that is a system in which an object is located by reception at that object of data transmitted by a global satellite. The use of such equipment is well known for locating ships and other vehicles, but has not been associated with gritting. Conventional GPS has an accuracy of only about 50–100 m. To determine which road the gritting vehicle is on even in an urban environment, the present invention preferably uses a variety of GPS known as a "Differential Global Positioning System" (DGPS), which increases the accuracy of the position determination to within a few meters. DGPS reduces noise in the signal received from a satellite by comparing the signal received from an antenna mounted on the gritting vehicle with a corresponding signal received by one or more stationary receivers in known locations, so that the location of the gritting vehicle can be derived from the difference between the two sets of signals. DGPS is a known technology per se.

Embodiments of the present invention are now described with reference to the accompanying figures, in which.

Figure 1:
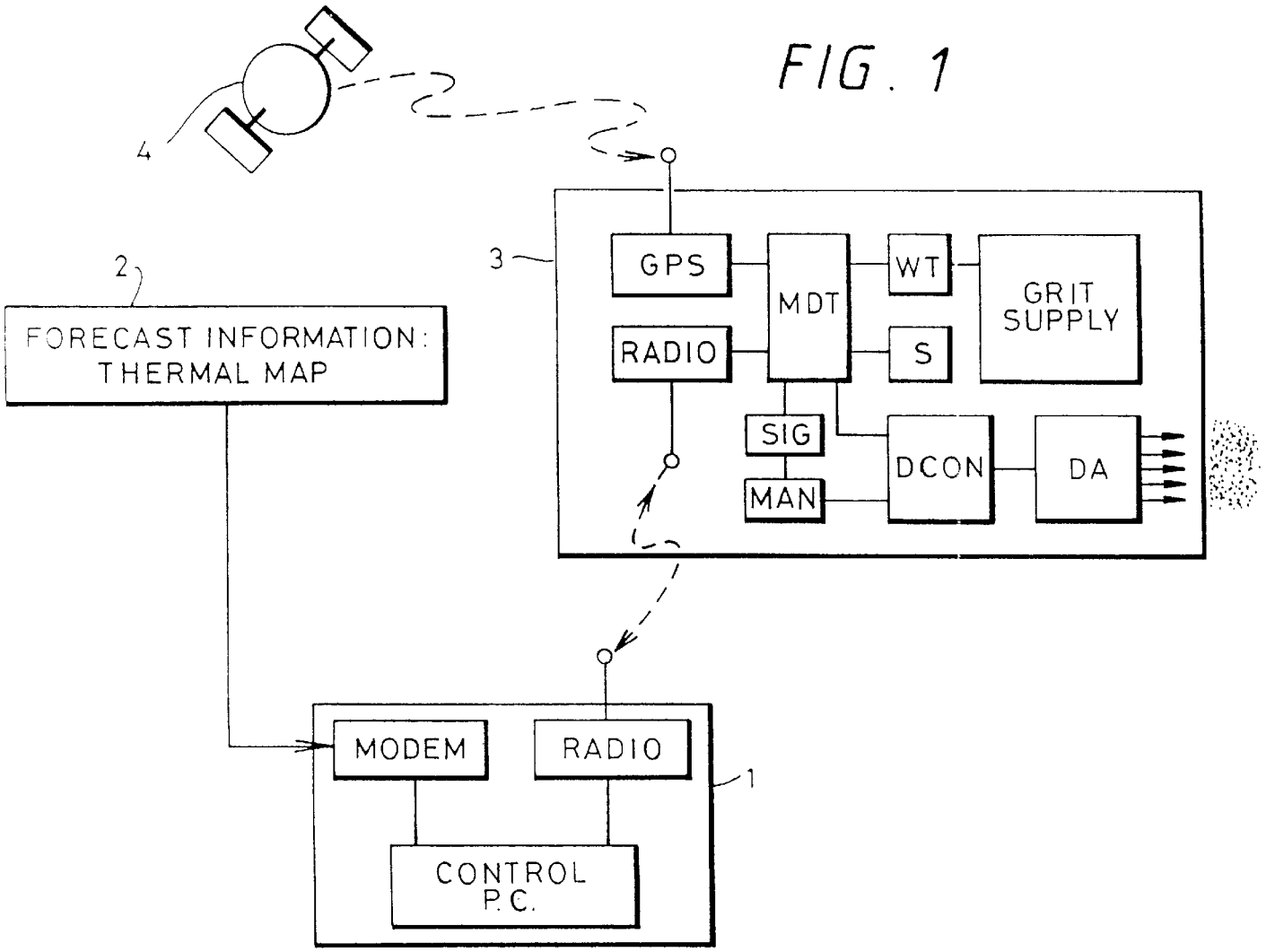
FIG. 1 is a schematic view of a gritting system.

FIG. 1 shows a gritting arrangement schematically. A gritting lorry 3, which may be one of plural lorries (e.g. 10 or more) under common control, carries a grit supply and a dispersing or dispensing arrangement DA for applying grit to the road. A conventional dispensing arrangement such as a spinning spreader disc may be used. It operates under the control of a dispensing control mechanism DCON. This can act on the dispensing arrangement to adjust one or more dispersion parameters e.g. spreading/not spreading, spread width, spreading rate (weight grit/unit area).

The vehicle's position is monitored on a substantially continuous basis by a position monitor, here a global positioning system GPS. This is adapted to receive data for position determination from one or more satellites 4. These systems are well known as such, and their installation and implementation in a vehicle does not present any special problems. We prefer DGPS, as mentioned above.

The GPS unit is connected to an on-board data processor or mobile data terminal MDT. This works with a data store in which gritting-related route information such as forecast thermal map data is stored. The processor MDT is connected to receive position data from the GPS unit and programmed to compare or relate this with the corresponding coordinates in the stored route information to derive gritting parameter (s) appropriate for the presumed local route conditions. The gritting parameter(s) may be transmitted to the dispensing control DCON and/or to a signalling display SIG for implementation via a manual control MAN.

The vehicle carries a RADIO transceiver for radio link communication with a corresponding transceiver at a fixed control centre 1 from which the vehicle(s) 3 is/are controlled and monitored. Route data, e.g. forecast thermal map data, can be sent through the radio link for storage in the vehicle's MDT. The CONTROL PC may obtain the data from a commercial forecast data supplier or contractor, edited into a suitable format and e.g. downloaded from the supplier's own database 2.

Various kinds of thermal map data may be used. One type has been described above. Another useful type may be prepared by predicting route surface temperatures over a contoured grid system, using survey information on altitude, local thermal patterns or fingerprints and wind characteristics (speed, direction, shelter). Such a map gives good results for temperatures near to freezing.

Figure 2:
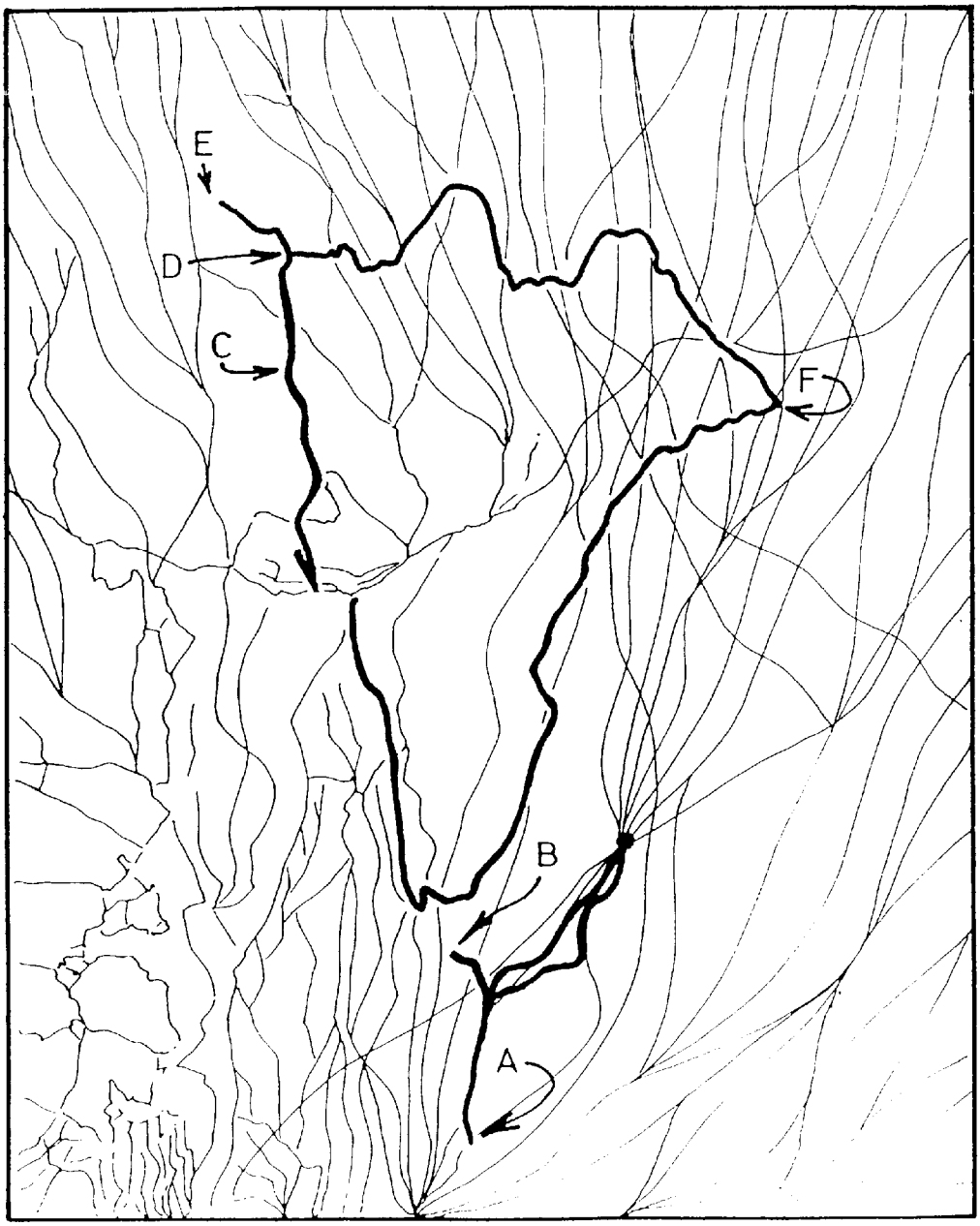
FIG. 2 shows one possible appearance of a forecast thermal map.

FIG. 2 shows a predetermined route of a gritting vehicle which begins at a point A and proceeds via points B, C, D and E to a destination F. In some portions of the route, the gritting vehicle must cover the same stretch of road twice. For example, after the gritting vehicle has covered the stretch from D to E, it must retrace its path from E to D before recommencing its journey to D to F.

The forecast thermal map illustrates the predicted temperature along the route of the gritting vehicle. For example, between points A and B the temperature is well above zero; between points B and C the temperature is close to zero; between points C and D the temperature is below zero; and between points D and E the temperature is well below zero. The map would typically show the different temperature zones using different colours on a display screen at the control centre.

In one procedure the gritting vehicle only applies grit in regions of the route which, according to the forecast thermal map, are close to zero temperature or colder, i.e. the gritting vehicle starts to apply grit at point B, or shortly before to provide a safety margin. Within these regions of the route, the gritting vehicle travels at a substantially constant speed and dispenses grit from the vehicle at a constant rate.

In a second procedure the gritting operation is controlled so that grit is dispensed at a faster rate in the colder parts of the road, for example at a higher rate between points D and E than between points C and D.

Thus in either procedure the grit is applied only in those regions in which it is required, while in the second procedure its density on the road is distributed more efficiently with respect to the temperature distribution of the road.

The required gritting control information may all be loaded into the gritting vehicle before it sets off on its journey, or it may be updated continually or periodically during travel by radio.

As described above, a software application in the MDT determines when the gritting operation should be started and stopped as the vehicle follows its predetermined route. If the gritting vehicle includes one or more sensors S then the MDT has an interface with this/these too.

The gritting operation may be automated e.g. using known control technology or the driver may retain some or total control of the gritting operation, receiving from the MDT at an audible and/or visible display instructions as to where to start or stop gritting or adjust the spread rate. For example indication lights and/or a speech synthesiser may be fitted in the vehicle cab.

The MDT monitors the location and activity of the vehicle and the corresponding data are sent via the digital RADIO network to the central control 1, either on demand or automatically at regular intervals.

The control centre 1 contains a control system referred to here as a Geographical Information System (GIS). It may consist of a PC connected to a local area network and packet radio modem to support the communications service.

The software of the fixed control system (GIS) may provide any or all of the following functions:

1. Route determination: e.g those routes which are predicted to have a minimum road surface temperature at or below 0° C. (and consequently to require treatment) are identified in colour on a graphical display depicting all routes. Those routes not requiring treatment default to a neutral colour. At this stage the duty officer may accept or modify the routes selected. The system then issues the appropriate instructions to the depot which prepares the gritting vehicles for their respective journeys, via a modem or tax.
2. Position and Status of Vehicle(s): e.g. the duty officer can observe the positional co-ordinates of the data together with each current status. Typical status parameters are:

whether the gritting is on or off;

the gritting rate of spread (eg. 10 g/m$^2$, 30 g/m$^2$ or 40 g/m$^2$);

the number of lanes of the road over which the gritting vehicle is spreading grit;

which lane on the road the vehicle occupies;

whether the vehicle is ploughing;

the weight of material in the gritting vehicle's hopper (note the possible weight sensor WT);

whether the spinner of the gritting vehicle is symmetrical ( indicating how the grit is being distributed);

the distance to a point at which the gritting operation should be altered;

the speed of the vehicle, and any detected system failure.

Software routines enable a display of the position and status of the gritting vehicle in real time on graphical visual display. The position and status of a gritting vehicle is represented by a marker "blip" superimposed over a (e.g.detailed ordnance survey) map background. The appearance e.g. colour and/or shape of each marker is determined according to the status of the vehicle. The same software can be used to analyse the records made of the activity or the gritting vehicle. The activity logs are stored in the system and can be maintained, enabling a complete record of gritting activity at a given time.

Figure 3:
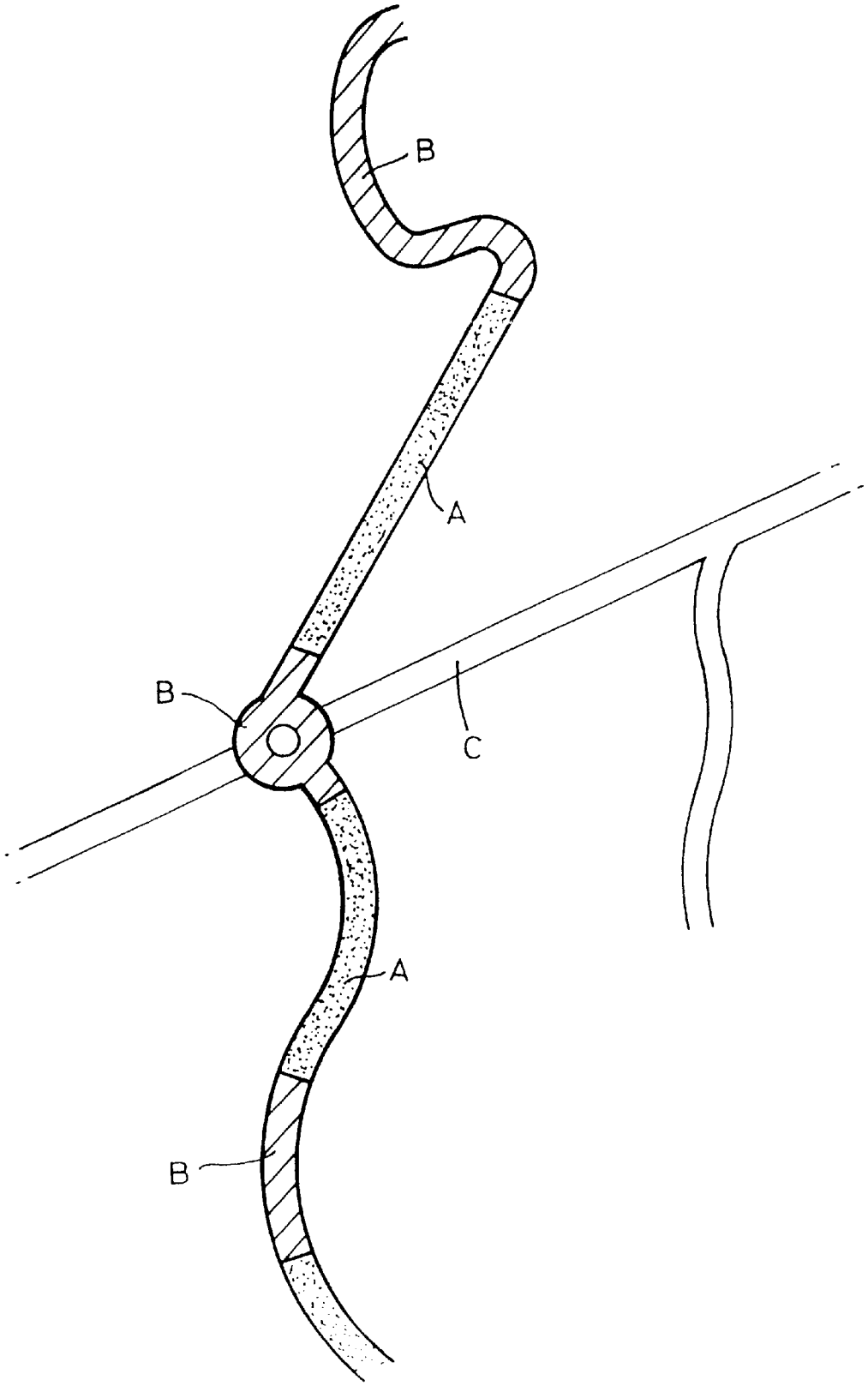
FIG. 3 shows schematically a small part of such a map.
Figure 4:
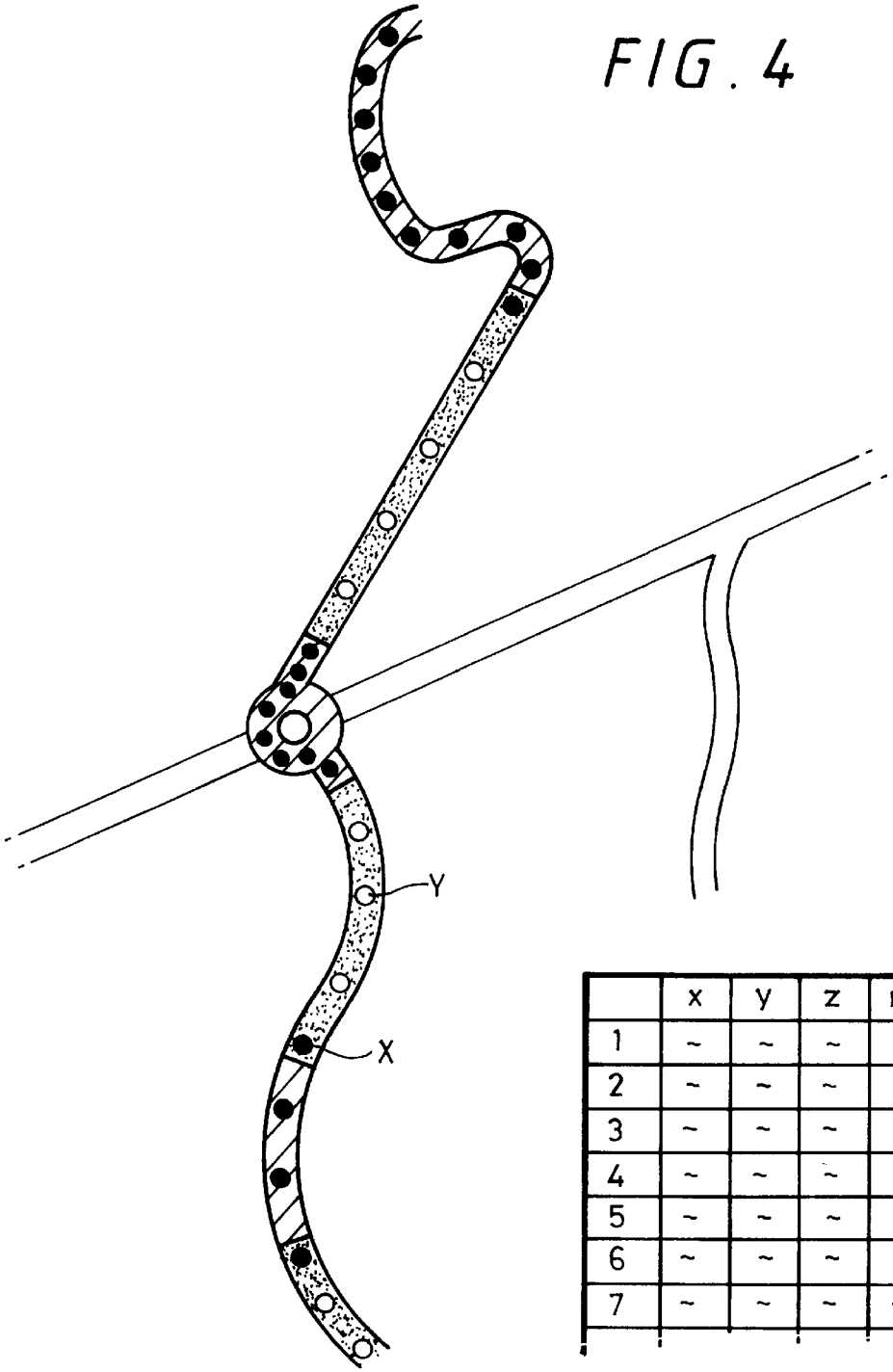
FIG. 4 shows the same part with actual gritting data recorded.

FIGS. 3 and 4 illustrate such a presentation. FIG. 3 shows the original forecast thermal map data as viewable at the control centre. Sections A of a main route are predicted to be in the range −1 to +1C, sections B in the range −3 to −1C. Another route C is deemed not worth gritting or is part of another route so no data are given. FIG. 3 shows the result, stored and viewable at the control center, after gritting. Each blob on the route represents a data packet sent at uniform short intervals, e.g. 15 s. The appearance of each blob indicates gritting density; solid is 20 and open is 10 g per sq. meter. FIG. 4 also indicates a concurrently-produced tabular record including for each packet (each row of the table) further information about the vehicle and gritting status (e.g. items as suggested above).

The activity log may form the basis of a management audit trial, for example to produce reports on the performance of contractors carrying out winter maintenance operations. It may also be used to derive and record the cost of gritting in overall terms and/or at the level of an individual vehicle. The data may also be used to ensure that an adequate supply of grit is maintained. In addition, the GIS may have the capability to analyse a forecast thermal map and combine sub-zero sections of more than one route (possibly taking into account information concerning response and treatment times, network impedance, gritting vehicle capacity and proximity to the depot) to design a new route that has the shortest distance between sections to be gritted, thus creating a unique route or set of routes, for example on a nightly basis. If, for example, two or three routes require a partial treatment, the GIS may create a single route out of the lengths to be treated, and the GPS may then trigger navigational instructions to the driver. In this way, it is possible for one vehicle to do the work of two or more with resulting savings in manpower, equipment and environmental damage.

In situations where weather conditions deteriorate resulting in a revision of a forecast thermal map it may be necessary to change the instructions to the gritting vehicle in real time. This can be achieved by an interactive combination of GPS and GIS. As information concerning the position and status of a gritting vehicle is sent back to the central control system, the GIS calculates the nearest vehicle with sufficient grit on board (sensors on the gritting vehicle may monitor the grit usage to provide this information) to treat the length of road where conditions have deteriorated: Information is then transmitted to that vehicle, including the necessary navigation instructions derived from the GPS. The revised route can be produced on hard copy in a printer and/or using a voice synthesizer.

In order to monitor the accuracy of the forecast, an infra red thermometer mounted on the gritting vehicle may measure road surface temperature and send the data back to the central control system e.g. via the radio system. At the central control system the data is compared with the forecast thermal map. Consequently, if there is a significant discrepancy between the data collected and the forecast data, the thermal map can be are-generated and the new data on treatment transmitted to the gritting vehicle en route.

Although the invention has been described above in relation to a single embodiment, many variations are possible within the scope of the invention. For example, in the production of the forecast thermal map the system may employ long term predictions of overall temperature so as to be able to predict well in advance which sections of road will require gritting, and act accordingly. Furthermore, although the invention has been described in relation to roads, it is equally applicable to other surfaces which may be gritted, for example rail tracks.

What is claimed is:

1. A gritting method in which a vehicle including gritting apparatus travels a route along a road and disperses grit, or other material adapted to prevent or reduce ice formation on the road in accordance with a gritting routine, the method comprising steps of:

progressively determining and monitoring a location of the vehicle along the route using a positioning system to generate monitored position data substantially continuously or regularly;

comparing, using an information processor, the monitored position data with stored route information comprising data indicative of varying location-dependent gritting requirements for the route;

generating a gritting instruction in dependence on the comparison, to control one or more adjustable parameters of the grit dispersion in a manner appropriate to the gritting requirements at the vehicle's position; and progressively storing grit dispersion data indicating the status of one or more of said adjustable parameters of the grit dispersion in conjunction with the corresponding position data, as the vehicle travels.

2. A method according to claim 1 comprising determining the location of the vehicle using a global positioning system (GPS) whereby the vehicle receives and processes data transmitted from a global satellite.

3. A method according to claim 2 in which the GPS is a differential global positioning system (DGPS) which corrects the determined position by comparing the satellite data received at the vehicle with corresponding satellite data received at one or more stationary receivers at known locations.

4. A method according to claim 1 in which the information processor is on the vehicle.

5. A method according to claim 4 in which the route information is transmitted to the vehicle's information processor for storage therein from a control station remote from the vehicle.

6. A method according to claim 1 in which the stored route information comprises a thermal map indicating temperatures at least along the route.

7. A method according to claim 6 in which the thermal map is a forecast thermal map and the temperatures are predicted temperatures.

8. A method according to claim 1 in which said grit dispersion data are transmitted from the vehicle to, and stored at, a control station remote from the vehicle.

9. A method according to claim 1 in which the monitored position data are progressively transmitted from the vehicle to a control station remote from the vehicle and the vehicle's progress is tracked at the control station.

10. A method according to claim 1 comprising monitoring conditions along the route using a sensor on the vehicle, and sending the resulting route condition data to the information processor.

11. A method according to claim 10 in which the gritting instructions can be adjusted in dependence on said route condition data.

12. A method according to claim 10 in which the detection of discrepancies between the route condition data and corresponding data from the stored route information triggers a revision of the stored route information.

13. A method according to claim 1, in which the information processor selects a route to be taken by the vehicle and signals a corresponding route instruction.

14. A method according to claim 1 in which one of said one or more adjustable parameters is a choice between dispersing and not dispersing material.

15. A method according to claim 1 in which one of said one or more adjustable parameters is a variable spreading density of material.

16. A method according to claim 1 in which the gritting instruction is transmitted to a control system of the gritting apparatus to automatically adjust said one or more adjustable parameters of the grit dispersion.

17. A method according to claim 1 in which the gritting instruction is transmitted to means for signalling to an operator of the vehicle.

18. A gritting control arrangement comprising:

a positioning system for determining and monitoring a location of a gritting vehicle on a route, to provide corresponding monitored position data; and an information processing arrangement adapted to receive said position data, said information processing arrangement comprising a route information store for storing data indicative of variable location-dependent gritting requirements along a route; means for comparing said monitored position data with the stored route information and determining one or more corresponding adjustable grit dispersion parameters appropriate for the location of the gritting vehicle, means for progressively storing grit dispersion data indicating the status of one or more of said adjustable parameters of the grit dispersion in conjunction with the corresponding position data as the vehicle travels, and means for generating a gritting instruction for controlling gritting apparatus in accordance with said one or more dispersion parameters.

19. A gritting control arrangement according to claim 18 in which the information processing arrangement includes an on-board information processor for the vehicle and a control processor for a control station remote from the vehicle, and the gritting control arrangement includes radio communication means for data to pass between said processors.

20. A gritting control arrangement according to claim 18 comprising a sensor for mounting on the gritting vehicle to monitor route conditions and to provide route condition data, said sensor being connected to send the route condition data to the route information store.

21. A gritting control arrangement according to claim 20 in which the information processing arrangement comprises means for detecting discrepancies between the route condition data from the sensor and corresponding existing data from the stored route information, and means for triggering a revision of the stored route information on the basis of said detected discrepancies.

22. A gritting control arrangement comprising:

a GPS positioning system for determining and monitoring the location of a gritting vehicle on a route along a road by means of data transmitted from a global satellite, to provide corresponding position data for the gritting vehicle in relation to said road route;

an information processing arrangement comprising:

an on-board information processor connected to receive said position data from the positioning system and to receive gritting status information from the gritting vehicle, said gritting status information indicating at least whether gritting is taking place, the information processor being programmed to associate current gritting status information with corresponding said position data for storage; and a control processor, for a control station remote from the gritting vehicle; and communication means for transmitting the associated gritting status and position data from the on-board information processor to the control processor for storage.

23. A gritting control arrangement according to claim 22 in which the information processing arrangement has a thermal map store for a forecast thermal map comprising data indicative of varying location-dependent gritting requirements for the road route, the information processing arrangement comparing the monitored position data with said stored route information to generate corresponding position-dependent gritting instructions as the gritting vehicle proceeds along the route.

* * * * *